US008129661B2

(12) United States Patent
Catini

(10) Patent No.: US 8,129,661 B2
(45) Date of Patent: Mar. 6, 2012

(54) PROFESSIONAL HAIR IRON

(76) Inventor: Mauro Catini, Civitanova Marche (IT)

( * ) Notice: Subject to any disclaimer, the term of this patent is extended or adjusted under 35 U.S.C. 154(b) by 543 days.

(21) Appl. No.: 12/303,404

(22) PCT Filed: Jun. 5, 2007

(86) PCT No.: PCT/EP2007/055532

§ 371 (c)(1),
(2), (4) Date: Dec. 4, 2008

(87) PCT Pub. No.: WO2007/141276

PCT Pub. Date: Dec. 13, 2007

(65) Prior Publication Data

US 2009/0188516 A1 Jul. 30, 2009

(30) Foreign Application Priority Data

Jun. 7, 2006 (IT) ..... BO20060053 U

(51) Int. Cl.
*A45D 1/04* (2006.01)
*A45D 1/06* (2006.01)

(52) U.S. Cl. ..... 219/225; 132/225

(58) Field of Classification Search ..... None
See application file for complete search history.

(56) References Cited

U.S. PATENT DOCUMENTS

| | | | | |
|---|---|---|---|---|
| 4,242,567 | A * | 12/1980 | Carter | 219/225 |
| 6,119,702 | A | 9/2000 | Habibi | |
| 6,191,387 | B1 * | 2/2001 | Smal | 219/225 |
| 6,223,753 | B1 | 5/2001 | Lo | |
| 6,941,955 | B2 * | 9/2005 | Yao | 132/225 |
| 7,341,064 | B2 * | 3/2008 | Habibi | 132/224 |
| 7,445,012 | B2 * | 11/2008 | Mukai | 132/224 |
| 7,465,904 | B2 * | 12/2008 | Kim et al. | 219/222 |
| 7,540,289 | B2 * | 6/2009 | Habibi | 132/224 |
| 2001/0022184 | A1 * | 9/2001 | Lee | 132/225 |
| 2002/0190047 | A1 | 12/2002 | Nam | |
| 2008/0283080 | A1 * | 11/2008 | Habibi | 132/224 |
| 2008/0283081 | A1 * | 11/2008 | Habibi | 132/224 |
| 2009/0114240 | A1 * | 5/2009 | Leung | 132/224 |

FOREIGN PATENT DOCUMENTS

WO WO2004/002263 A 1/2004

OTHER PUBLICATIONS

International Search Report.

* cited by examiner

*Primary Examiner* — Joseph M Pelham
(74) *Attorney, Agent, or Firm* — William J. Sapone; Coleman Sudol Sapone P.C.

(57) ABSTRACT

In a professional hair iron, a unit (U) is defined by a lower support element (2) and an upper support element (3) hinged together and movable between a rest, open position and an operation, closed position. Complementary facing plates (20, 30, 300, 333) are removably fastened to the support elements (2,3). Heating electric resistors (R) are inserted within the plates and at least one plate of the plates (20, 30, 300, 333) has a perforated portion connected to a supply pipe (C) in turn connected to a steam generator (G) to supply steam to the perforated portion so as to moisten a lock of hair laid between the plates fastened to the support elements (2,3).

16 Claims, 5 Drawing Sheets

FIG. 5
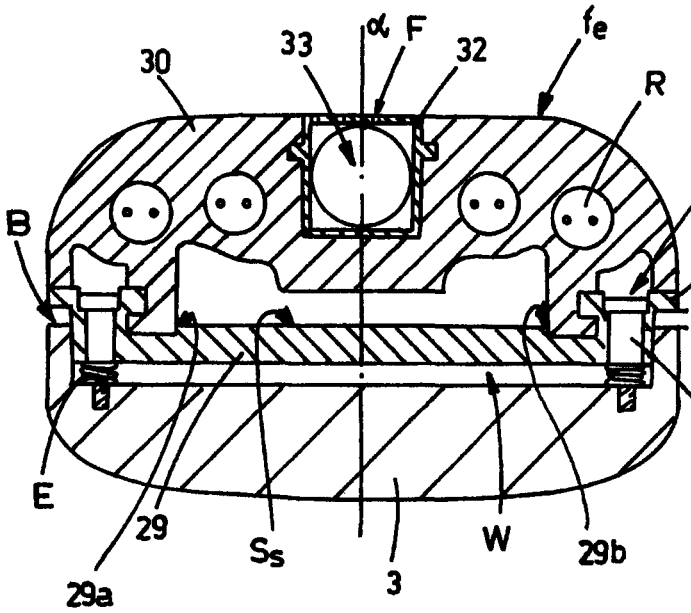
FIG. 5A
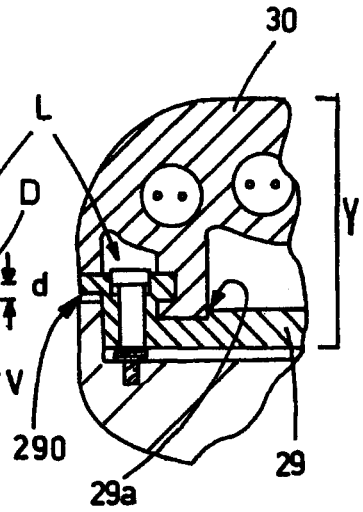
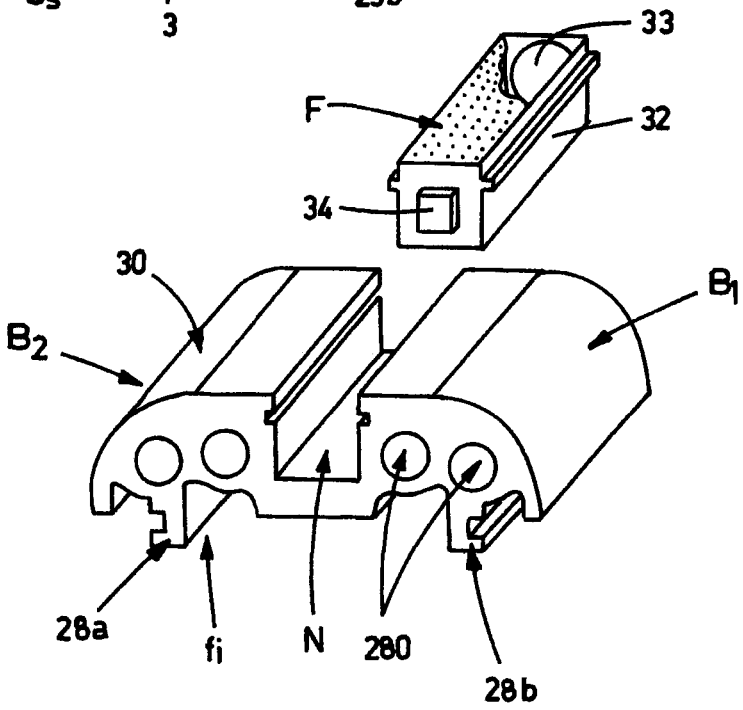
FIG. 6

PROFESSIONAL HAIR IRON

BACKGROUND OF THE INVENTION

The present invention relates to professional hair straightening irons. In particular, the invention relate to hair irons used for straightening curled or wavy hair, or for creating sinusoidal, triangular, square waves, and so on in one or more locks of hair.

DESCRIPTION OF PRIOR ART

Hair irons are tools used by hair-dressers for straightening curled or wavy hair, or for creating particular patterns, such as sinusoidal, triangular, square waves, etc. on one or more locks of hair.

The iron plate is formed by two support elements, lower and upper, hinged together and operated, by using corresponding handles, to set the plate into operation, that is to its close position.

The support elements have guides, or grooves, for instance extending longitudinally, for coupling with complementary grooves, or guides, made in respective facing plates, a lower plate and an upper plate, respectively.

The plates have mirror profiles, are interchangeable and their contact surfaces are flat for straightening hair, or are patterned with complementary profiles forming particular waves along their longitudinal or transversal extension, so to obtain the desired hairstyle.

Moreover, the iron has heating means for heating the above mentioned lower and upper plates.

After having set the plates on the iron, the heating means are activated, a lock of hair is laid on the lower plate and the iron is operated by mating the opposite surfaces of the plates.

The use of plates with flat or patterned profiles, together with the heat, allows to straighten the hair or to obtain the desired waving on the lock.

Another kind of known hair iron is equipped with a small tank, connected to the support elements. The tank communicates, via suitable ducts made in the support elements, with one of the plates, which has a plurality of holes on its entire surface. The operator uses this type of iron in the same way as the traditional irons, and, in addition, with a suitable control he can convey some drops of water contained in the tank, to the heated plate: the water, touching the plate hot surface, creates steam, which goes out through the holes made in the same plate.

However, this type of iron has some disadvantages.

Its dimensions are bigger with respect to the traditional irons and consequently it is little handy.

Another disadvantage derives from the fact that using this system it is not possible to control the steam temperature, since the evaporation of the water drops depends on the plate's temperature.

During the iron use, the steam discharged by the corresponding plate can burn the client's skin.

Another disadvantage of this iron results from the fact that it is necessary to feed the tank continuously, with a considerable waste of time, since its capacity does not allow a long time use.

SUMMARY OF THE INVENTION

The object of the present invention is to propose a professional iron which overcomes the prior art disadvantages.

Another object of the invention is to propose an iron, which is shaped in such a way, as to allow, by one operation only, to straighten the hair and to stabilize a waving at the hair ends (hair ends turned downward or upward).

A further object of the invention is to propose a professional iron, which can be used also by unskilled operators.

A still further object of the invention is to propose a hair iron, which is particularly handy.

A yet further object is to propose an iron, which can be obtained at low cost with respect to its performance.

The above mentioned objects are achieved by the present invention, in accordance with the contents of claims, by a professional hair iron characterized by including:

- a unit defined by two support elements, namely a lower support element and an upper support element, hinged together to move between a rest, open position, and an operation, closed position;
- complementary facing plates, respectively a lower plate and an upper plate, removably fastened to relevant free ends of said lower support element and upper support element;
- heating means, associated to each plate of said facing plates, for stabilizing a lock of hair laid between the facing plates.

BRIEF DESCRIPTION OF THE DRAWINGS

The characteristic features of the invention are pointed out by reference to the enclosed drawings, in which:

FIG. 5 is an enlarged, section view taken along line V-V of FIG. 3;

FIG. 5A shows a part of the section view according to line V-V of FIG. 3, with the proposed iron operation condition being pointed out;

FIG. 6 is an enlarged-scale, perspective, exploded view of the detail K of FIG. 3;

BEST MODES OF CARRYING OUT THE INVENTION

Figure 1:
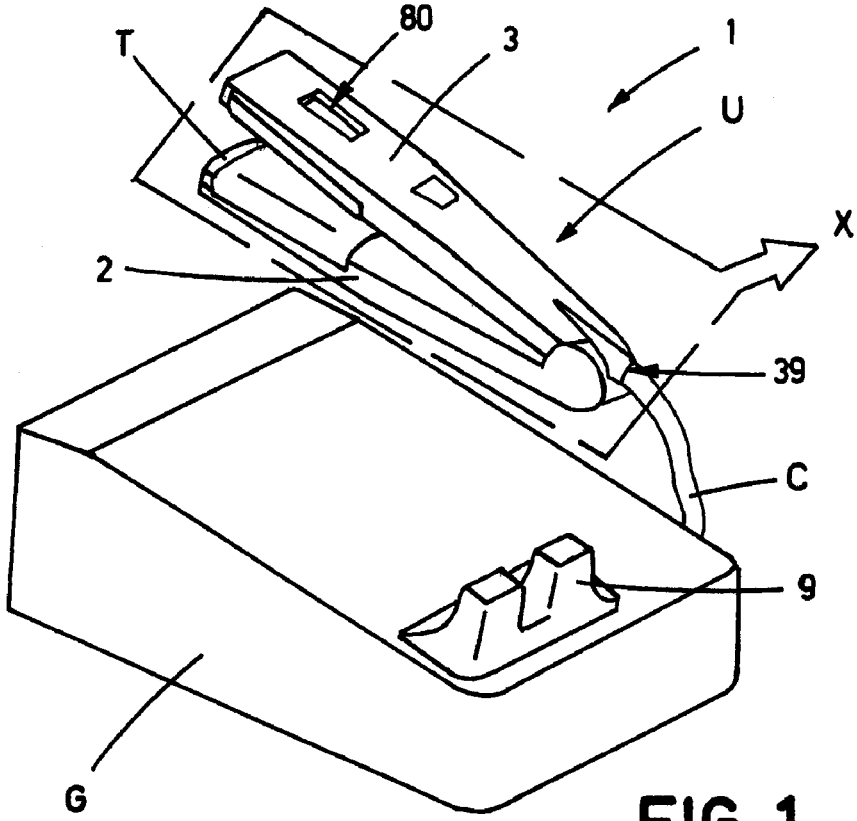
FIG. 1 is a perspective, reduced scale view of a hair iron, proposed by the invention.

With reference to the enclosed Figures, reference numeral 1 indicates a professional hair iron.

The iron 1 is formed by a unit U and a known steam generator G, including a support 9, on which the unit U is placed, when the iron is not in operation.

The steam generator G is connected to an inlet 39 of the unit U, by feeding means C.

The unit U is composed of two support elements 2, 3, a lower element 2 and an upper element 3, hinged together, due to the hinged connection, the lower element 2 and upper element 3 can take a rest, open position, and an operation close position.

Each element 2, 3 (FIG. 4) includes a rear part Pp, close to the hinge area, a central part Pc and an outer part Pe.

Figure 4:
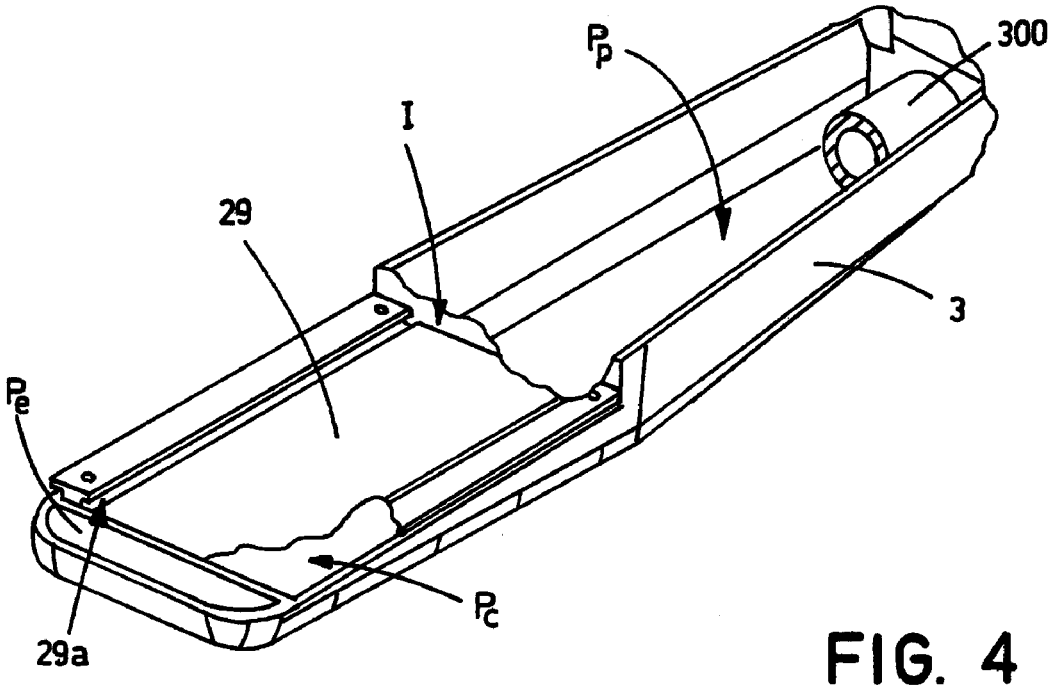
FIG. 4 is a perspective view of a part of a support element of the hair iron, proposed by the invention.
Figure 7:
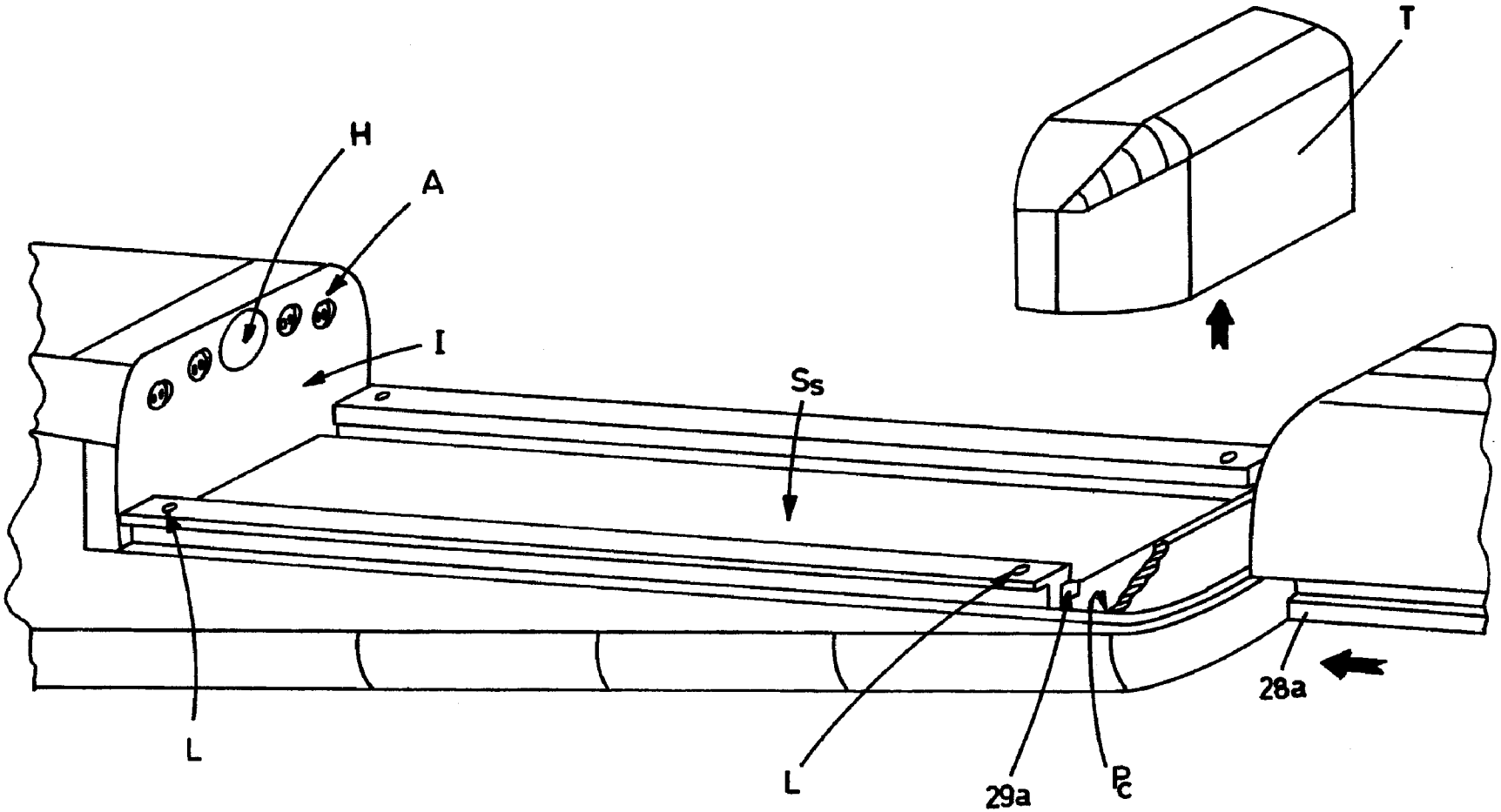
FIG. 7 is an enlarged-scale, prospective and exploded view of a support element of hair iron, proposed by the invention.

The rear part Pp is hollow and has a tube 300, partially shown in FIG. 4 and leading to an outlet H (FIG. 7), which is made in the vertical fore part I of the same rear part Pp.

The central part Pc has a recess W, and its thickness is smaller with respect to the rear part. The outer part Pe is shaped in such a way, as to receive removably a closing element, or plug T (FIG. 7), fixed by known means e.g. snap means, or screw means, not shown: the upper surface of the outer part Pe is coplanar with the upper surface of the adjacent central part Pc.

A group Y, connected to the central part Pc (FIG. 5A), is defined by a plate receiving element 29 (FIGS. 4, 7), fastened to the latter, and by a plate 20, 30 joined to the plate receiving element 29, as described later on.

As shown in FIGS. 4, 5, the plate receiving element 29 has longitudinally extending guides 29*a*, 29*b*, made along the edges of the upper surface Ss of the plate receiving element 29, symmetrically with respect to a vertical symmetry plane α(FIG. 5) and shaped in such a way that the guides 29*a*, 29*b* have longitudinal edges 290 folded outwards, so as to define corresponding longitudinal abutments D.

The plate receiving element 29 has vertical holes L, made e.g. beside the edges 290 for receiving known screw means V, which fasten, with the interposition of elastic means E, the plate receiving element 29 to the inner surface of the recess W of the central part Pc: a distance "d" is delimited between the longitudinal edges B of the support elements 2, 3 and the lower surface of the longitudinal abutments D (FIG. 5).

The lower surface fi of the plate 20, 30 has flanges 28*a*, 28*b*, which couple slidingly with the guides 29*a*, 29*b* of the lower portion 29, while the longitudinal edges B1, B2 of the plate outer surface fe are rounded.

The inner part of the plate 20, 30 has longitudinal seats 280, e.g. four, in which corresponding heating means R are introduced.

The upper plate 30 (FIGS. 5, 6) features also a channel N, arranged central with respect to the outer surface, within which a hollow body 32 is introduced slidingly and is fixed by known coupling means.

The hollow body 32 is accessible from the rear through an opening 33 and communicates with outside through a series of holes F made in the upper surface.

The fore surface of the hollow body 32 has e.g. a stabilizing member 34, which couples with a complementary seat (not shown) in the outer part Pe of the corresponding support element 2, 3.

Figure 9:
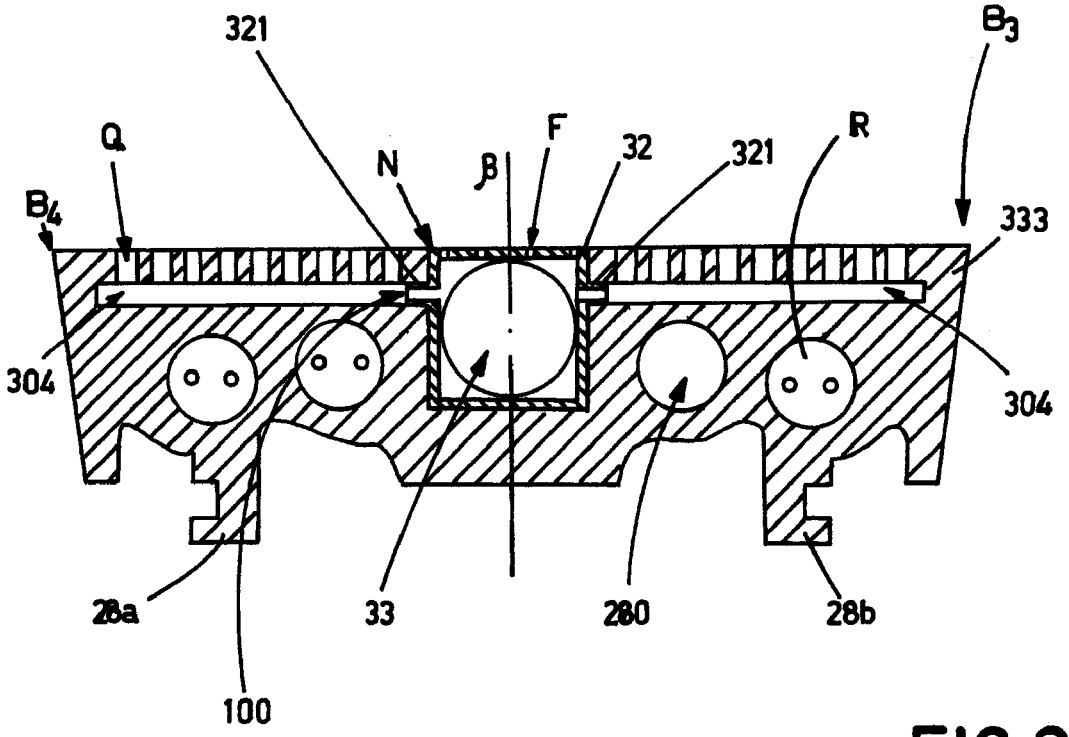
FIG. 9 is an enlarged-scale, section view of a second embodiment of detail K of FIG. 3.
Figure 8:
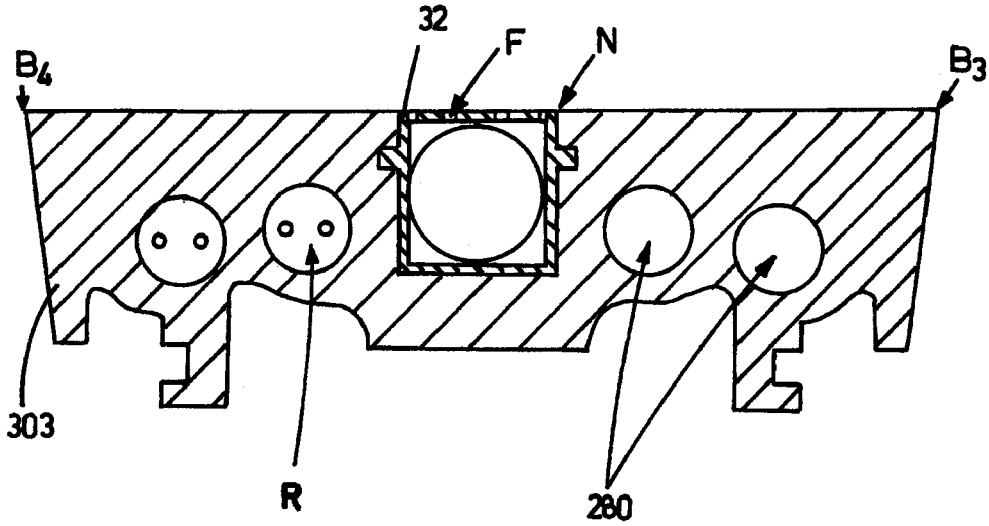
FIG. 8 is an enlarged-scale, section view of a first embodiment of detail K of FIG. 3.

According to a first and a second embodiment (FIGS. 8, 9), the longitudinal edges B3, B4 of the lower plate (not shown), as well as of the upper plate 303, 333 are tapered.

According to the second embodiment (FIG. 9), transversal guide slots 304 extend from the channel N of the upper plate 333, perpendicular and symmetrical to a central plane βand communicate with the upper surface through a series of further holes Q: the slots 304 extend along the whole length of the upper plate.

Guide elements 321 of the hollow body 32, introduced sliding into the slots 304, set the hollow body 32 inside space into communication with the transversal slots 304 through suitable openings 100.

It is understood that the guide transversal slots 304, as well as the holes Q, can be made also in the upper plate 30, described previously.

Figure 2:
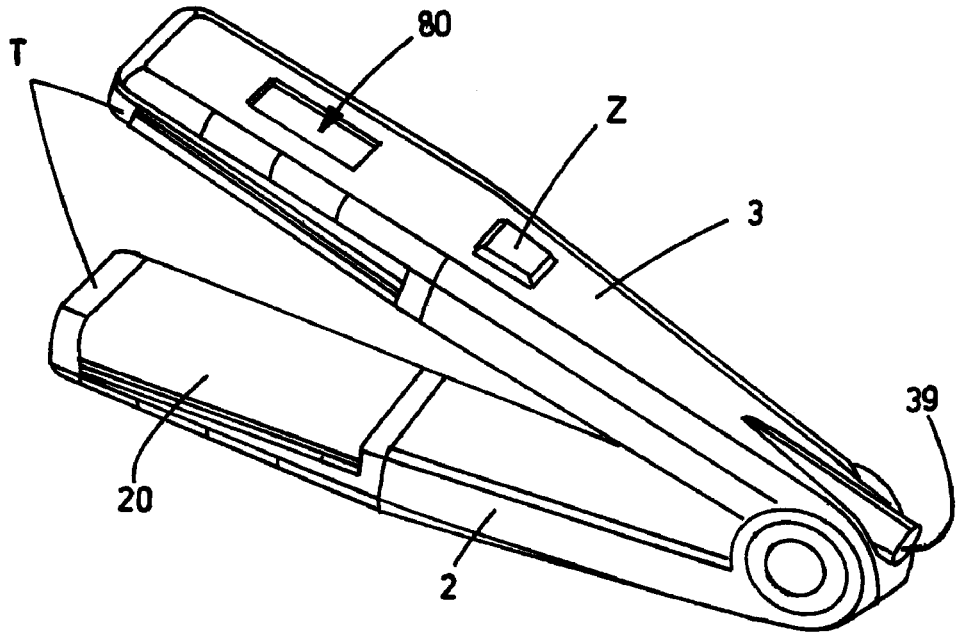
FIG. 2 is an enlarged-scale, perspective, upper lateral view of detail X of FIG. 1.
Figure 3:
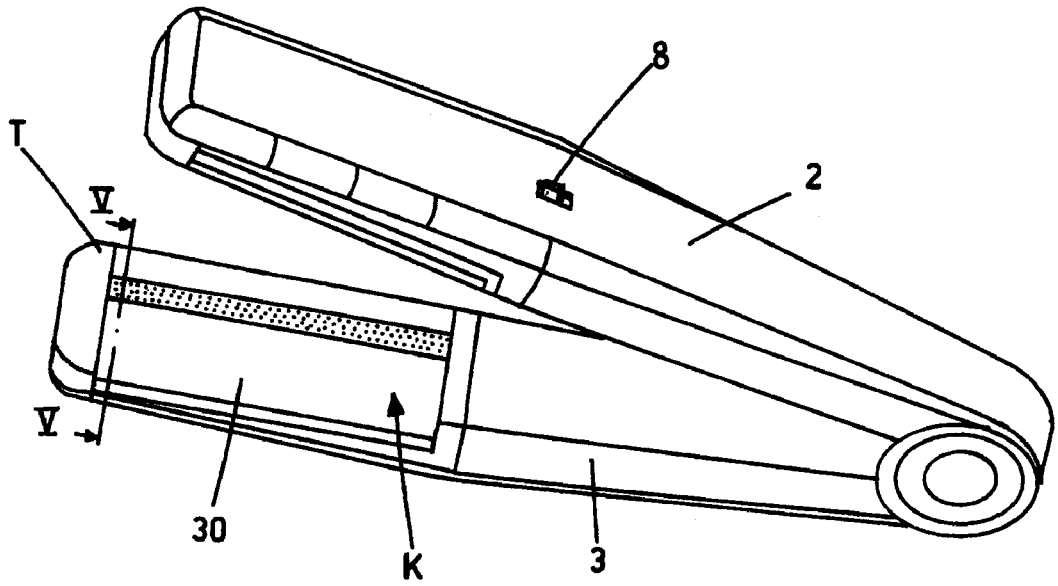
FIG. 3 is an enlarged-scale, perspective, lower lateral view of detail X of FIG. 1.

The heating means R, e.g. resistors, can be activated separately, by known activating means 8, connected e.g. to the lower support element 2 (FIG. 3) and coupled to a thermometer 80, which is associated to one of the support elements, e.g. to the upper one 3 (FIG. 2).

In the beginning, the use of the iron 1 includes setting the plates 20, 30, 303, 333 in the corresponding support elements 2, 3 (FIG. 7): for each element, the plug T is removed, the flanges 28*a*, 28*b* of each plate are introduced into the longitudinal guides 29*a*, 29*b* of the lower portion 29, so that the rear surface of each plate goes in abutment against the vertical wall I of the rear part Pp of each support element 2, 3, and finally the plug T is reset in its position.

In this configuration, the heating means R are connected to corresponding plugs A (supplied with low voltage in known way), made in the vertical wall 1, the opening 33 of the upper plate 30, 303, 333 communicates with the outlet H of the upper support element 3, so as to be connected to the inlet 39, by the tube 300.

In operation condition, the heating means R are powered and the generator G is activated, by known control means Z (FIG. 2), e.g. a switch connected to the upper support element 3, to create steam in the latter.

The operator lays a lock of hair on the upper surface of the lower plate 20 and then closes the support elements, so that the upper plate 30, 303, 333 contacts the lock of hair placed on the lower plate 20.

Due to the action of the heating means, the plates 20, 30, 303, 333 are preheated in such a way, that their temperature, together with the operator's manual action, straightens the lock of hair interposed between the plates 20, 30, 303, 333, lower and upper.

Particular curving of the longitudinal edges of the plates 20, 30 makes it possible to give the ends of the hair of the lock of hair a desired shape, or in other case the particular tapering of the edges of the lower and upper plates 303, 333 straightens the lock of hair up to the hair root.

Closing of the elements also operates known devices, not shown, such as a micro-switch, situated in the hinging area of the support elements 2, 3, 303, 333, to make the steam created by the steam generator G to reach the unit U.

Therefore, the flow of steam created by the generator G passes through a pipe, inside the supply means C, then through the tube 300, and flows into the hollow body 32 to be discharged through the holes F. According to the second embodiment, the steam flows also through the holes Q, so as to moisten the lock of hair situated between the lower and the upper plate 20, 30, 303, 333.

The professional hair iron is particularly advantageous because it uses the steam generator G, associated to the unit U, which allows to supply the latter with steam during the whole hair-set operation, thus speeding up and improving the hair locks straightening.

Scented essences can be added to the quantity of water to be evaporated contained in the steam generator G. When the water is evaporates, also the essences are taken to the plate and exit through the holes F of the body 32 and, if present, through the holes Q, Otherwise, other products can be combined with the steam to better moisten the hair cuticle, to improve straightening and/or setting of the hair, making the hair softer and more fluffy.

If the steam discharge is blocked by the obstruction of the holes F of the body 2, e.g. by scale, it is possible to disassemble the corresponding plate with simple movements, remove the body 32 therefrom and substitute it.

Moreover, the fact that the body 32 covers only the central part of the corresponding plate is advantageous, because it allows to moisten primarily the lock of hair placed between the plates, thus eliminating the possibility to burn the client's skin during the hair-set operation.

Producing the steam in the steam generator G is advantageous, because it is possible to check the water temperature by known devices.

The curved edges of the plates upper portion allow to use the iron for hair straightening as well as for styling the hair ends in a desired way: the hair ends follow the shape of the plates edges thus taking the desired curving (straight hairstyles with the ends curved inwards or outwards.

Moreover, the curving of the rounded edges prevents the locks of hair from being folded badly on the same edges, due to the iron closing and use.

The fact that the lower and upper plates have the edges tapered outwards allows the proposed iron to be used in more ways.

Such plates make it possible to straighten in fact the hair lock up to the root, since the edges tapering allows to place the iron unit close to the skin, avoiding the skin burning during its use, because closing the support elements move the plates close to each other, forming a kind of beak: the plates portion close to the skin is very small.

The hair iron proposed by the present invention can be used also on dry hair with more or less marked waving: the steam exiting from the upper plate allows to moisten the hair lock placed between the plates and to facilitate its straightening, and in case of extremely dry hair, it allows to avoid hair damage, since the cuticle is moisturized.

Further, according to the kind of hair to be straightened, it is possible to activate all the plates heating resistors, so as to increase the plates temperature, in order to facilitate and speed up the hairstyle stabilization.

The fact that the heating resistor activating means 8 and the control means Z for producing steam in the generator G are associated to the unit U, is advantageous, because it makes the unit U easily operated by the operator according to the kind of hair to be straightened.

Another advantage results from the fact that the lower portion 29 is subjected to the elastic means E, because this fact makes the iron 1 straighten the hair perfectly even when the quantity of hair closer to the hinging area is bigger/smaller than the quantity of hair closer the support elements ends.

In this situation, the distance "d" is variable; actually, when the quantity of hair closer to the hinging area is bigger than the quantity of hair closer to the support elements ends, with the iron in operation, the distance "d" near the hinging area becomes bigger than the distance "d" near the support elements ends.

The positive characteristic features of the proposed iron appear obvious from what has been said above; even though it uses known elements, it proposes an innovating solution for the hair ironing, which allows to obtain all the objects mentioned in the introductory note, giving to the proposed iron necessary reliability, safety, handiness and durability.

The iron safety is underlined by the fact that the unit U is supplied in known way with low voltage.

It is obvious that the plates associated to the unit U can be substituted with plates having surfaces with patterned profiles, with at least one of them shaped in such a way, as to have a portion with holes for discharging the steam produced by the steam generator G.

It is also obvious that the upper plate as well as the lower plate may include the body 32, and, by using suitable devices, may convey the steam flow to both support elements, to allow the steam to be discharged by both plates to moisten the hair lock placed between the plates to a greater extent and in less time.

It is also pointed out that, by using suitable technical contrivances, it is possible to disconnect the unit U from the steam generator G and to use the unit U as a traditional hair iron, with all the advantages deriving from its conformation and from the different plates heating system.

It is understood that what above has been described as a not limiting example, therefore possible practical-usage variations remain within the protective scope as described above and claimed below.

The invention claimed is:

1. A professional hair iron comprising:

a unit (U) defined by a lower support element (2) and an upper support element (3), hinged together to move between a rest, open position, and an operation, closed position, a lower plate and an upper plate, disposed in a facing relationship, the lower plate being removably fastened to a free end of said lower support element (2) and the upper plate being removably fastened to a free end of said upper support element (3);

heating means (R), associated to said facing lower and upper plates, for heating a lock of hair laid between the facing lower and upper plates;

a perforated portion made in at least one of said facing upper and lower plates (20, 30, 300, 333);

supply means (C) interposed between said perforated portion and a steam generator (G) for supplying steam to said perforated portion, so that said steam is discharged from said perforated portion to moisten a lock of hair laid between the facing lower and upper plates fastened to said support elements (2, 3); and, wherein said perforated portion includes a hollow body (32), introduced slidingly into a channel (N) made centrally in an outer surface of at least said upper plate (30), said hollow body (32) having an opening (33) made in a rear part thereof for receiving steam produced by said steam generator (G) and for discharging the received steam through a series of holes (F) made in an upper surface of said hollow body (32), so as to moisten the lock of hair located between the lower and upper plates removably fastened to the lower and upper support elements (2, 3).

2. A professional hair iron as claimed in claim 1, further comprising an upper plate receiving element (29) and a lower plate receiving element (29), each plate receiving element being elastically fastened to a respective upper and lower support element (2, 3), each of said upper plate and said lower plate being coupled with the respective upper plate receiving element and the lower plate receiving element.

3. A professional hair iron as claimed in claim 2, wherein each plate receiving element (29) has a pair of facing longitudinally extending guides (29*a*, 29*b*), located along opposed edges of an upper surface (Ss) of each plate receiving element (29), each guide (29*a*, 29*b*) having a pair of edges (290), an inner extending edge and an outer extending edge, the pair of outer extending edges forming abutments (D) for mating with the respective upper or lower plate member, the pair of inner extending edges forming a pair of channels for slidingly receiving flanges (28*a*, 28*b*) extending from the upper and lower plate members, said upper and lower plate members having longitudinally extending passages (280) for receiving the heating means (R) therein.

4. A professional hair iron as claimed in claim 1 further comprising a pair of transversal guiding slots (304) which extend from said channel (N), perpendicular and symmetrical to a central plane, the transversal guide slots being in communication with the upper surface through a series of holes (Q), said hollow body (32) having a pair of guide elements (321) received slidingly within said slots (304), said pair of guide elements having holes (100) for delivering steam from the hollow body to said transversal slots (304).

5. A professional hair iron as claimed in claim 3, wherein said lower and upper plates (20, 30) each have longitudinally extending outer surfaces (B1, B2) that are rounded.

6. A professional hair iron as claimed in claim 3, wherein said lower and upper plates each have longitudinally extending outer surfaces (B1, B2) that are tapered outwards.

7. A professional hair iron as claimed in claim 3, wherein said plate receiving elements each have vertical screw receiving holes (L), said upper and lower plate receiving elements attached by screw means and elastic means (29) to an inner surface of a recess (W) made in the central part (Pc) of said support element (2, 3).

8. A professional hair iron as claimed in claim 1, wherein activating means (8) are provided for activating a part of or all said heating means (R).

9. A professional hair iron as claimed in claim 1 further comprising control means (Z) located within one of said support elements (2, 3) for activating said steam generator (G), a switch device situated in a hinge area of said support elements (2, 3) for making the steam produced by said steam generator (G) flow to said hollow body (32) when said unit (U) is set to the operation position.

10. A professional hair iron as claimed in claim 1 further comprising connecting means (C) having a pipe disposed therein and having one end connected to the steam generator (G) and another end connected to an inlet (39) made in one of the support elements, the inlet (39) leading to a tube (300) communicating, through an outlet (H) made in said upper support element (3), with said hollow body (32), to convey the steam produced by said steam generator G to said body (32).

11. A professional hair iron as claimed in claim 1, further comprising a temperature sensor located in one of said support elements, to measure a temperature of said lower and upper plates (20, 30, 303, 333).

12. A professional hair iron as claimed in claim 1, wherein said unit (U) is connected to a low voltage power supply.

13. A professional hair iron as claimed in claim 3 further comprising a pair of transversal guiding slots (304) which extend from said channel (N), perpendicular and symmetrical to a central plane, the transversal guide slots being in communication with the upper surface through a series of holes (Q), said hollow body (32) having a pair of guide elements (321) received slidingly within said slots (304), said pair of guide elements having holes (100) for delivering steam from the hollow body to said transversal slots (304).

14. A professional hair iron comprising:

a unit (U) defined by a lower support element (2) and an upper support element (3), hinged together to move between a rest, open position, and an operation, closed position, a lower plate and an upper plate, disposed in a facing relationship, the lower plate being removably fastened to a free end of said lower support element (2) and the upper plate being removably fastened to a free end of said upper support element (3);

heating means (R), associated to said facing lower and upper plates, for heating a lock of hair laid between the facing lower and upper plates; and, wherein closing elements (T) are removably fastened to outer parts (Pe) of said upper and lower support elements (2, 3) to allow coupling and uncoupling of said upper and lower plates (20, 30, 303, 333) to and from said upper and lower support elements, said outer parts located at extremities of the free ends of said upper and lower support elements.

15. A professional hair iron as claimed in claim 14, further comprising an upper plate receiving element (29) and a lower plate receiving element (29), each plate receiving element being elastically fastened to a respective upper and lower support element (2, 3), each of said upper plate and said lower plate being coupled with the respective upper plate receiving element and the lower plate receiving element.

16. A professional hair iron as claimed in claim 14, wherein a temperature sensor (T) is associated to one of said support elements, to measure the temperature of said plates (20, 30, 303, 333).

* * * * *